US007222945B2

(12) United States Patent
Tseng et al.

(10) Patent No.: US 7,222,945 B2
(45) Date of Patent: May 29, 2007

(54) FLUID EJECTION APPARATUS

(75) Inventors: Fan-Chung Tseng, Hsinchu (TW); Kuo-Tong Ma, Taipei (TW); In-Yao Lee, Taipei (TW); Te-Jung Hsu, Chia-I (TW)

(73) Assignee: BENQ Corporation, Taoyuan (TW)

( * ) Notice: Subject to any disclaimer, the term of this patent is extended or adjusted under 35 U.S.C. 154(b) by 170 days.

(21) Appl. No.: 10/871,834

(22) Filed: Jun. 18, 2004

(65) Prior Publication Data

US 2004/0263576 A1 Dec. 30, 2004

(30) Foreign Application Priority Data

Jun. 24, 2003 (TW) ..... 92117078 A

(51) Int. Cl.
*B41J 2/05* (2006.01)

(52) U.S. Cl. ..... 347/62; 347/61; 347/65

(58) Field of Classification Search ..... 347/48, 347/56, 61, 63, 67, 62, 65
See application file for complete search history.

(56) References Cited

U.S. PATENT DOCUMENTS 6,102,530 A * 8/2000 Kim et al. ..... 347/65
6,984,025 B2 * 1/2006 Kaneko et al. ..... 347/61
2002/0167564 A1 11/2002 Chou et al.
2003/0001924 A1 1/2003 Chou et al.

FOREIGN PATENT DOCUMENTS

| | | |
|---|---|---|
| CN | 1290211 A | 4/2001 |
| DE | 10220614 A1 | 1/2003 |
| DE | 10228849 A1 | 1/2003 |
| JP | 05-338178 | 12/1993 |

* cited by examiner

*Primary Examiner*—Matthew Luu
*Assistant Examiner*—Lisa M. Solomon
(74) *Attorney, Agent, or Firm*—Quintero Law Office

(57) ABSTRACT

A fluid ejection apparatus. The fluid ejection apparatus includes a chamber, a manifold, an orifice, a first bubble generating element and a second bubble generating element. The chamber contains fluid. The manifold is connected to the chamber. The fluid flows into the chamber at a first direction through the manifold. The orifice is connected to the chamber. The first bubble generating element is disposed above the chamber and close to the orifice to generate a first bubble. The first bubble generating element is substantially parallel to the first direction. The second bubble generating element is disposed above the chamber and is substantially parallel to the first direction to generate a second bubble. The second bubble generating element is close to the orifice and opposite to the first bubble generating element. The fluid in the chamber is ejected via the orifice by the first and second bubbles.

5 Claims, 8 Drawing Sheets

FLUID EJECTION APPARATUS

BACKGROUND OF THE INVENTION

1. Field of the Invention

The present invention relates to a fluid ejection apparatus, and in particular to a fluid ejection apparatus that generates a virtual valve.

2. Description of the Related Art

Referring to FIG. 1, U.S. Pat. No. 6,102,530 discloses an inkjet device 1 which can generate a virtual valve. Two heaters 20, 22 are disposed beside an orifice 18. Ink 26 flows into a chamber 14 through a manifold 16.

Referring to FIG. 2A and FIG. 2B, the inkjet device 1 ejects the ink 26 using the heating speed difference between the heaters 20 and 22. Namely, the heater 20 reaches a predetermined temperature to vaporize the ink 26 to form a bubble 30 thereunder. As the size increases, the bubble 30 serves as a virtual valve to 20 isolate the chamber 14 from the manifold 16. The heater 22 then reaches the predetermined temperature required to vaporize the ink 26 to form another bubble 32 thereunder. The two bubbles 30 and 32 push the ink 26 to eject the ink 26 via the orifice 18.

Accordingly, the heaters 20 and 22 have different resistances, such that the heaters 20 and 22 have different heating speeds. The bubbles 30 and 32 formed thereunder have different forming speeds to generate the virtual valve. Thus, when the inkjet device 1 ejects the ink 26, the crosstalk therein is prevented and satellite ink droplets are reduced.

Nevertheless, since the resistances of the heaters 20 and 22 in the inkjet device 1 are different, the sizes of the heaters 20 and 22 must be accurately controlled to match the geometric shape of the chamber 14 and the orifice 18. Otherwise, the ink 26 in the chamber 14 is ejected obliquely or not ejected. Thus, the design of the inkjet device 1 is complex and the manufacture thereof is difficult.

Hence, there is a need to provide a fluid ejection apparatus to allow the ink therein to eject vertically and stably.

SUMMARY OF THE INVENTION

Accordingly, an object of the invention is to provide a fluid ejection apparatus to overcome the aforementioned problems. The fluid ejection apparatus comprises a chamber, a manifold, an orifice, a first bubble generating element and a second bubble generating element. The chamber contains fluid. The manifold is connected to the chamber. The fluid flows into the chamber in a first direction through the manifold. The orifice is connected to the chamber. The first bubble generating element is disposed above the chamber and close to the orifice to generate a first bubble. The first bubble generating element is substantially parallel to the first direction. The second bubble generating element is disposed above the chamber and substantially parallel to the first direction to generate a second bubble. The second bubble generating element is close to the orifice and opposite to the first bubble generating element. The fluid in the chamber is ejected via the orifice by the first and second bubbles.

Preferably, the materials of the first and second bubble generating elements are the same.

Preferably, the ratio of the width of the first bubble generating element to the width of the second bubble generating element is between 0.8 and 1.2.

Preferably, the width of the first bubble generating element is equal to the width of the second bubble generating element.

Preferably, the ratio of the distance between the center of the first bubble generating element and the center of the orifice to the diameter of the orifice is between 0.7 and 1.3, and the ratio of the distance between the center of the second bubble generating element and the center of the orifice to the diameter of the orifice is between 0.7 and 1.3.

Preferably, the distance between the center of the first bubble generating element and the center of the orifice is equal to the distance between the center of the second bubble generating element and the center of the orifice.

Preferably, a wire is connected to the first and second bubble generating elements.

Preferably, a third bubble generating element is substantially disposed above the connection between the manifold and the chamber to generate a third bubble to server as a virtual valve.

Preferably, the third bubble generating element is connected to the first and second bubble generating elements.

Preferably, the third bubble generating element is substantially perpendicular to the first and second bubble generating elements.

Preferably, the materials of the first, second and third bubble generating elements are the same.

Preferably, the distance between the center of the first bubble generating element and the center of the orifice, the distance between the center of the second bubble generating element and the center of the orifice and the distance between the center of the third bubble generating element and the center of the orifice are the same.

Preferably, the ratio of the distance between the center of the third bubble generating element and the center of the orifice to the diameter of the orifice is between 0.8 and 1.2.

Preferably, the ratio of the distance between the center of the third bubble generating element and the center of the orifice to the diameter of the orifice is between 0.5 and 5.

Preferably, a wire is connected to the first, second and third bubble generating elements.

Preferably, the ratio of the length of the third bubble generating element to the diameter of the orifice is between 0.5 and 2.

Preferably, the first, second and third bubble generating elements are resistor-type heaters. The resistance of the third bubble generating element is greater than the resistance of the first bubble generating element and the resistance of the second bubble generating element.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

First Embodiment

Figure 1:
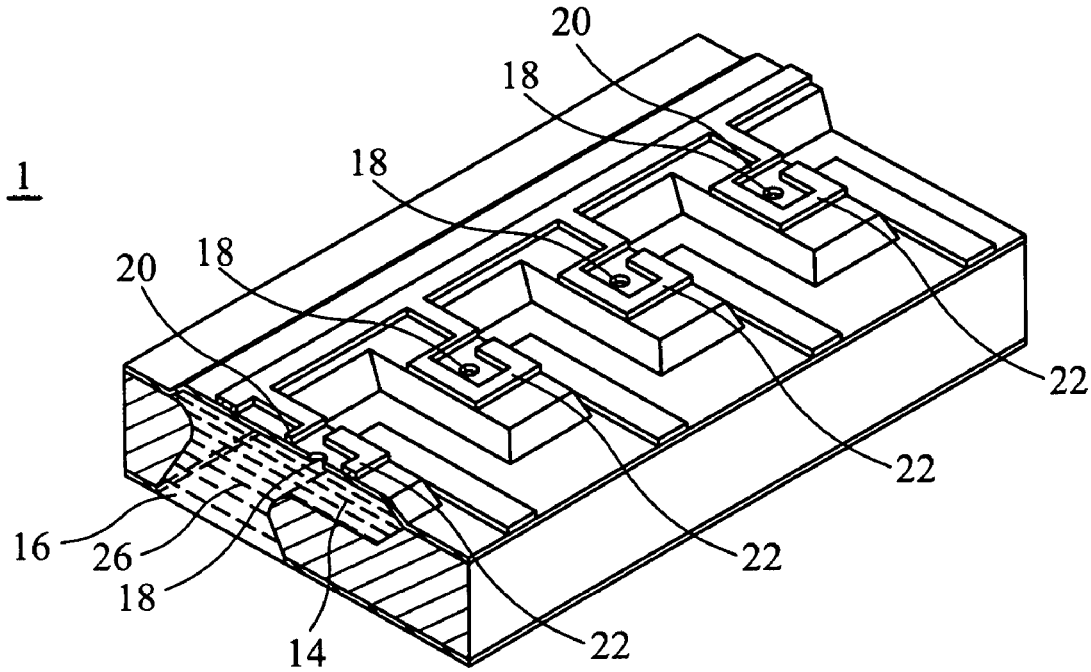
FIG. 1 (PRIOR ART)
FIG. 1 shows a conventional inkjet device.
Figure 2A:
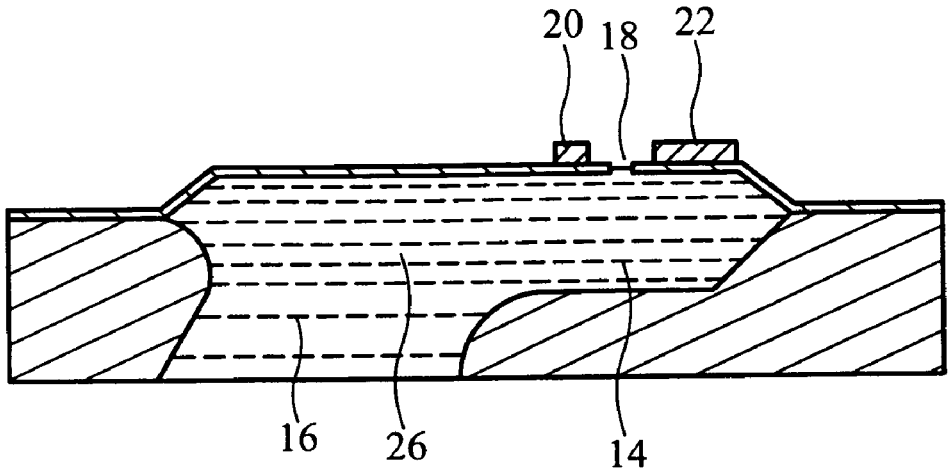
FIG. 2A (PRIOR ART)
FIG. 2A is a perspective side view according to FIG. 1.
Figure 2B:
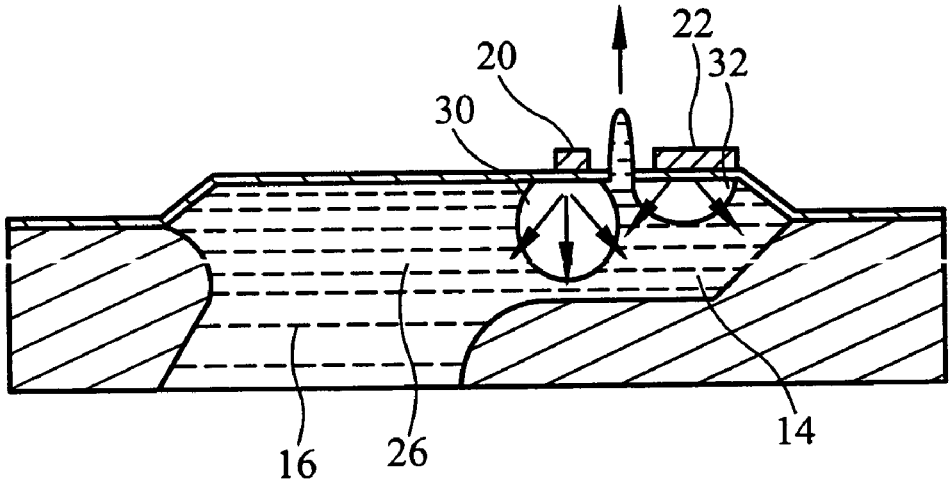
FIG. 2B (PRIOR ART)
FIG. 2B is another perspective side view according to FIG. 1.
Figure 3A:
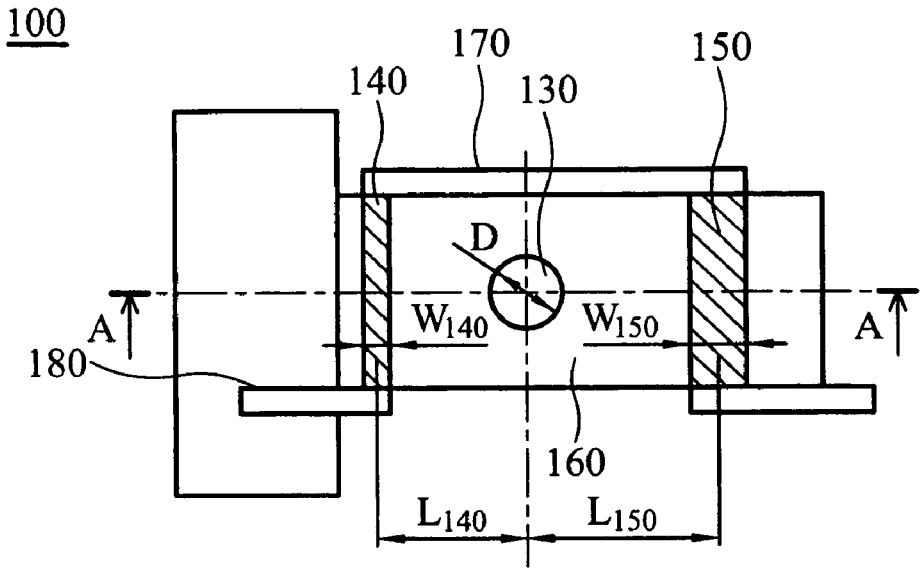
FIG. 3A is a schematic top view showing the fluid ejection apparatus of the first embodiment of the invention.
Figure 3B:
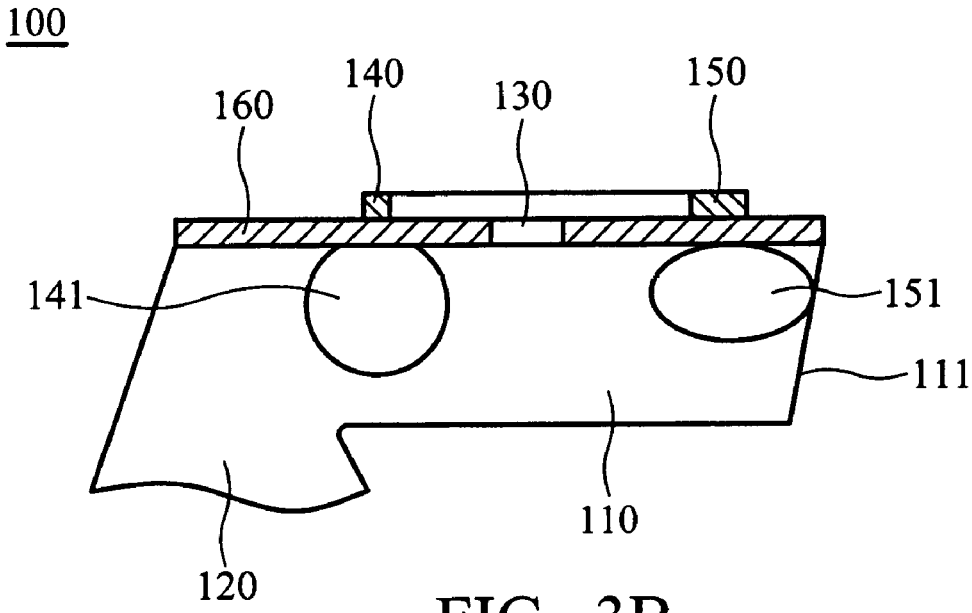
FIG. 3B is a schematic cross section taken along A-A of FIG. 3A.
Figure 3C:
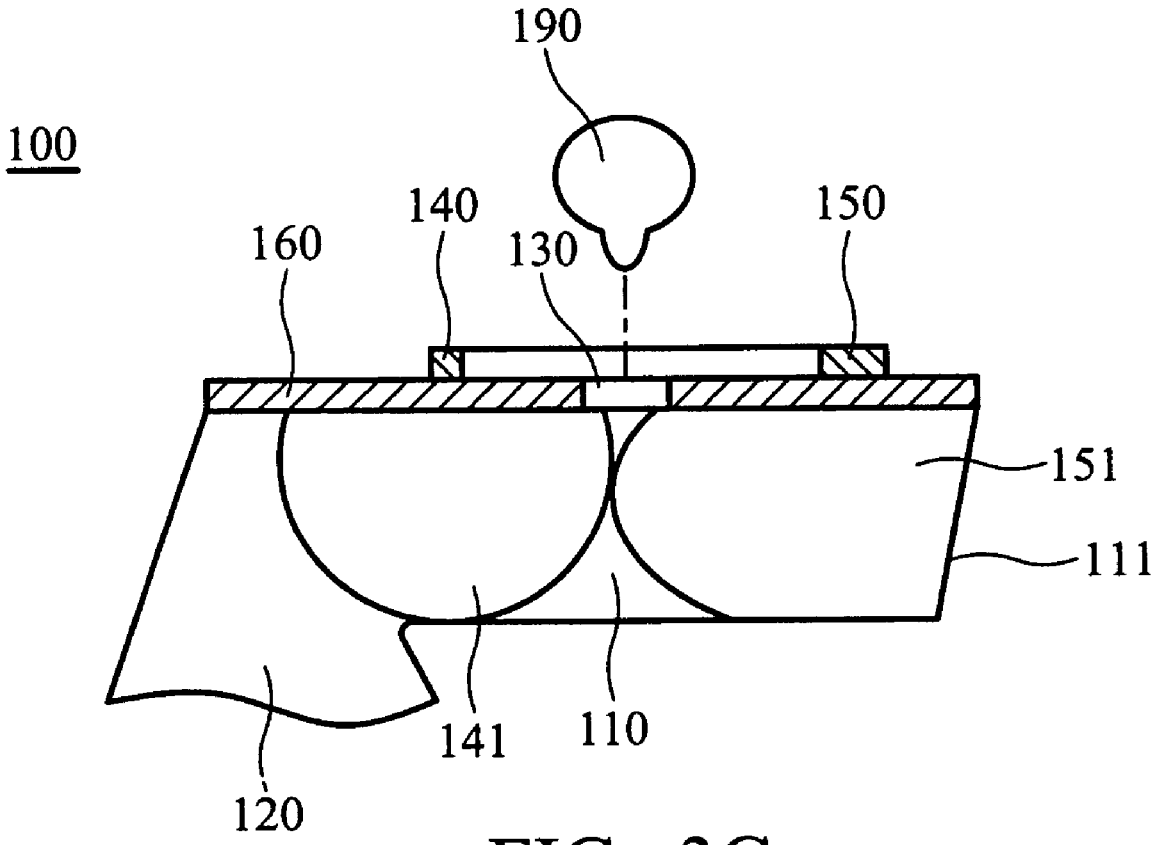
FIG. 3C is another schematic cross section taken along A-A of FIG. 3A.

Referring to FIG. 3A, FIG. 3B and FIG. 3C, the fluid ejection apparatus 100 of this embodiment includes a chamber 110, a manifold 120, an orifice 130, a first bubble generating element 140, a second bubble generating element 150 and a substrate 160. The manifold 120 is connected to the chamber 110. Fluid, such as ink, flows into the chamber 110 through the manifold 120. The orifice 130 is formed on the substrate 160 and is connected to the chamber 110. The first bubble generating element 140 is disposed above the chamber 110 and close to the orifice 130. The second bubble generating element 150 is disposed above the chamber 110 and close to the orifice 130. As shown in FIG. 3A, the first bubble generating element 140 and second bubble generating element 150 are disposed beside the orifice 130 and opposite to each other. Additionally, the fluid ejection apparatus 100 further includes a wire 170 connected to the first bubble generating element 140 and second bubble generating element 150.

In this embodiment, the ratio of the width $W_{140}$ of the first bubble generating element 140 to the width $W_{150}$ of the second bubble generating element 150 is between 0.8 and 1.2, and the length of the first bubble generating element 140 is equal to the length of the second bubble generating element 150. Meanwhile, the diameter of the orifice 130 is D. The ratio of the distance $L_{140}$ between the center of the first bubble generating element 140 and the center of the orifice 130 to the diameter D of the orifice 130 is between 0.7 and 1.3. The ratio of the distance $L_{150}$ between the center of the second bubble generating element 150 and the center of the orifice 130 to the diameter D of the orifice 130 is between 0.7 and 1.3.

Specifically, the materials of the first and second bubble generating elements 140, 150 are the same, and the material of the wire 170 has low resistance.

Accordingly, when the fluid ejection apparatus 100 is loaded with electric current via a wire 180, the electric current sequentially flows through the first bubble generating element 140, wire 170 and second bubble generating element 150. The first and second bubble generating elements 140, 150 are respectively heated because of their resistances. Meanwhile, since the material of the wire 170 has low resistance, heat generated thereby can substantially be omitted.

When the temperatures of the first and second bubble generating elements 140, 150 continue to rise, the ink thereunder is heated and vaporized to a first bubble 141 and a second bubble 151, respectively, as shown in FIG. 3B. Since the volume of the first bubble generating element 140 is smaller than the volume of the second bubble generating element 150, the resistance of the first bubble generating element 140 is larger than the resistance of the second bubble generating element 150. The heat generated by the first bubble generating element 140 is thereby greater than the heat generated by the second bubble generating element 150. Formation of the first bubble 141 under the first bubble generating element 140 is faster than formation of the second bubble 151 under the second bubble generating element 150. Accordingly, since formation of the first bubble 141 is faster, the chamber 110 is thereby isolated from the manifold 120 when the first bubble 141 reaches a predetermined size. At this point, the first bubble 141 serves as a virtual valve. In another aspect, the second bubble 151 also continues to increase in size. The second bubble 151 is constrained by the wall 111 of the chamber 110 and pushes the ink in the chamber 110 with the first bubble 141. Then, the ink in the chamber 110 is ejected via the orifice 130 and in the form of an ink droplet 190 by the first bubble 141 and second bubble 151, as shown in FIG. 3C.

Second Embodiment

Figure 4A:
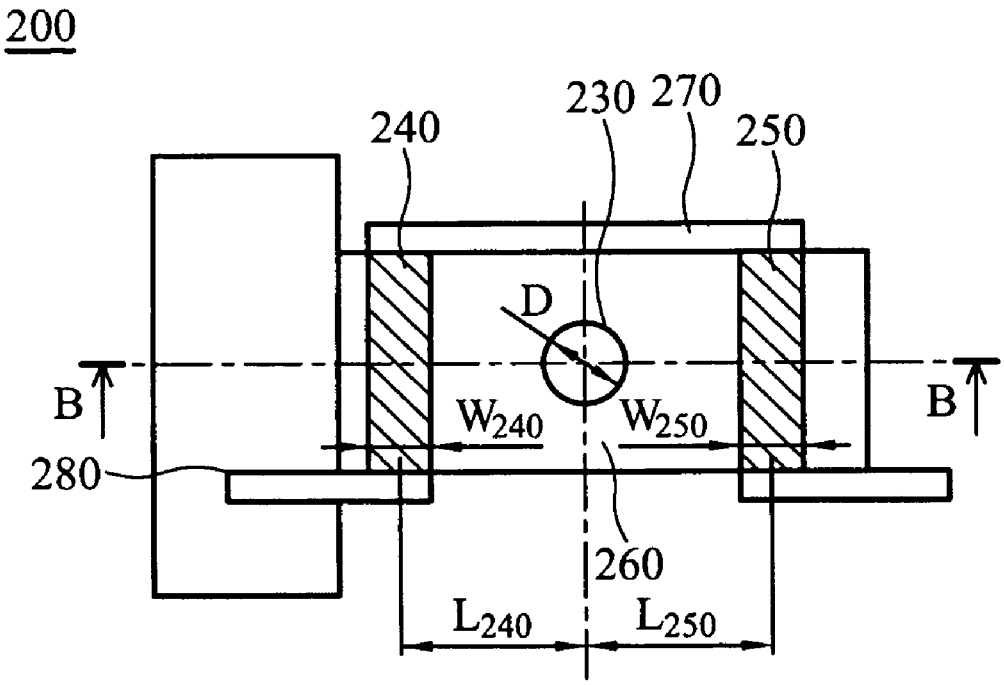
FIG. 4A is a schematic top view showing the fluid ejection apparatus of the second embodiment of the invention.
Figure 4B:
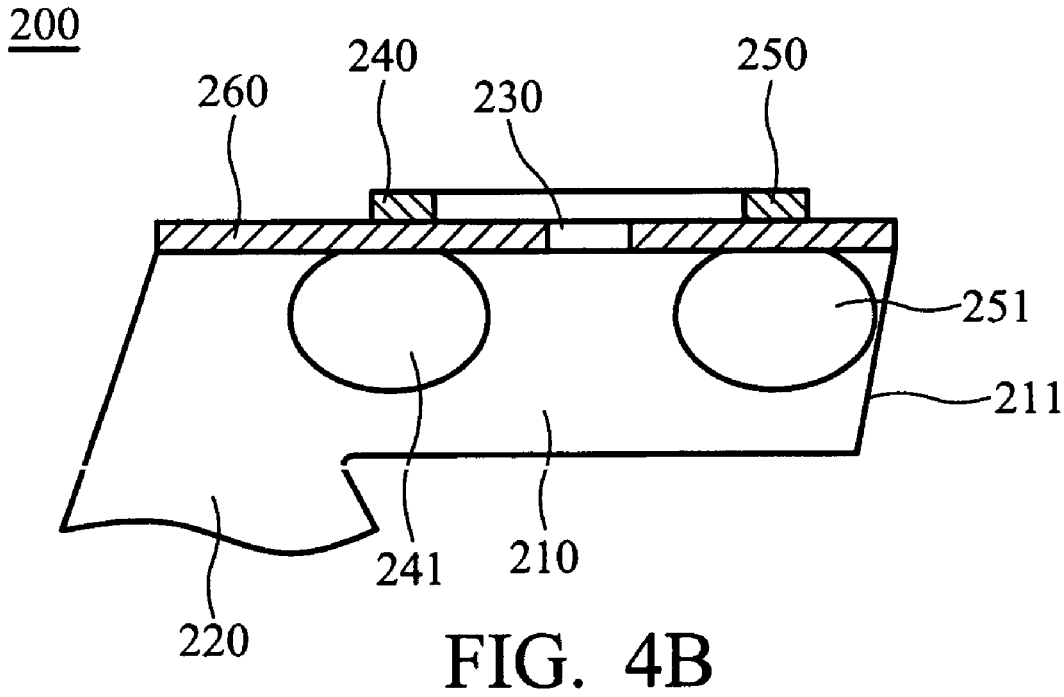
FIG. 4B is a schematic cross section taken along B-B of FIG. 4A.
Figure 4C:
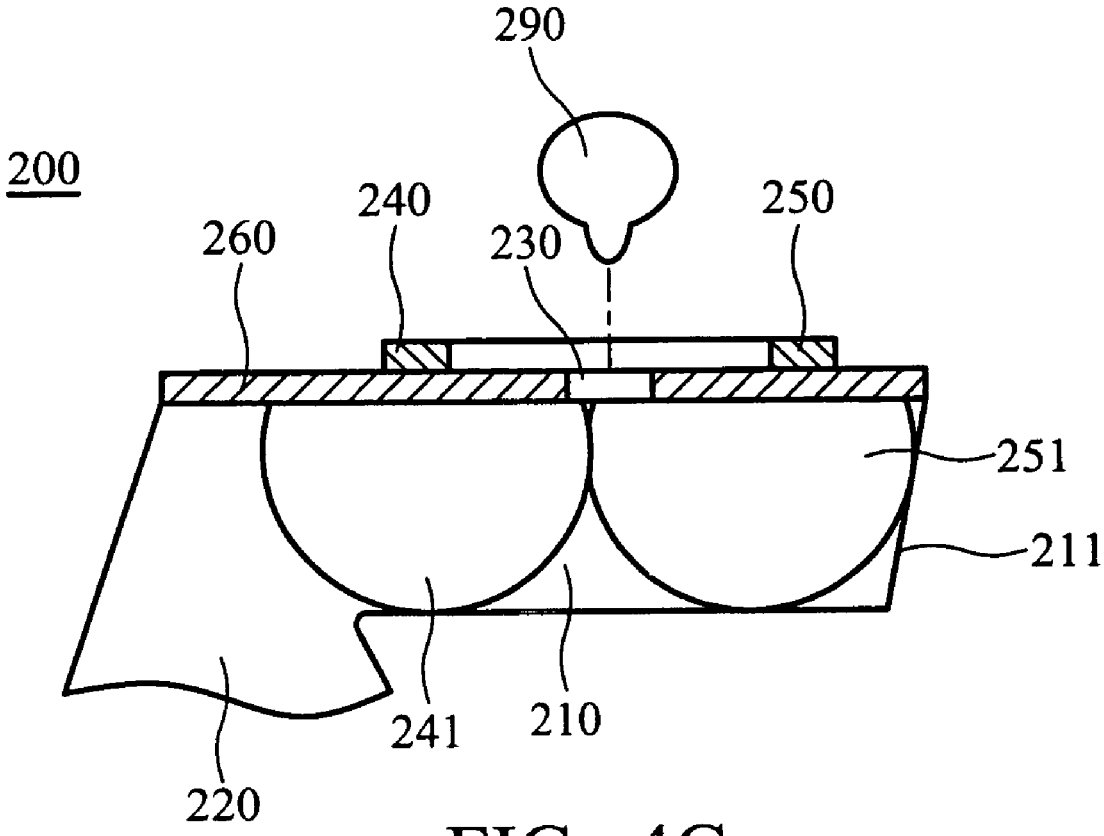
FIG. 4C is another schematic cross section taken along B-B of FIG. 4A.

Referring to FIG. 4A, FIG. 4B and FIG. 4C, the fluid ejection apparatus 200 of this embodiment includes a chamber 210, a manifold 220, an orifice 230, a first bubble generating element 240, a second bubble generating element 250 and a substrate 260. The manifold 220 is connected to the chamber 210. Fluid, such as ink, flows into the chamber 210 through the manifold 220. The orifice 230 is formed on the substrate 260 and is connected to the chamber 210. The first bubble generating element 240 is disposed above the chamber 210 and close to the orifice 230. The second bubble generating element 250 is disposed above the chamber 210 and close to the orifice 230. As shown in FIG. 4A, the first bubble generating element 240 and second bubble generating element 250 are disposed beside the orifice 230 and opposite to each other. Additionally, the fluid ejection apparatus 200 further includes a wire 270 connected to the first bubble generating element 240 and second bubble generating element 250.

In this embodiment, the width $W_{240}$ of the first bubble generating element 240 is equal to the width $W_{250}$ of the second bubble generating element 250, and the length of the first bubble generating element 240 is equal to the length of the second bubble generating element 250. Meanwhile, the diameter of the orifice 230 is D. The distance $L_{240}$ between the center of the first bubble generating element 240 and the center of the orifice 230 is equal to the distance $L_{250}$ between the center of the second bubble generating element 250 and the center of the orifice 230. The ratio of the distance $L_{240}$ or $L_{250}$ to the diameter D of the orifice 130 is between 0.7 and 1.3.

Specifically, the materials of the first and second bubble generating elements 240, 250 are the same, and the material of the wire 270 has low resistance.

Accordingly, when the fluid ejection apparatus 200 is loaded with electric current via a wire 280, the electric current sequentially flows through the first bubble generating element 240, wire 270 and second bubble generating element 250. The first and second bubble generating elements 240, 250 are respectively heated because of their resistances. Meanwhile, since the material of the wire 270 has low resistance, heat generated thereby can substantially be eliminated.

When the temperatures of the first and second bubble generating elements 240, 250 continue to rise, the ink thereunder is heated and vaporized to a first bubble 241 and a second bubble 251, respectively, as shown in FIG. 4B. Specifically, since the $W_{240}$ of the first bubble generating element 240 is equal to the width $W_{250}$ of the second bubble generating element 250, the volume of the first bubble generating element 240 is equal to the volume of the second bubble generating element 250. Namely, the resistance of the first bubble generating element 240 is equal to the resistance of the second bubble generating element 250. The heat generated by the first bubble generating element 240 is thereby equal to the heat generated by the second bubble generating element 250. The forming of the first bubble 241 under the first bubble generating element 240 is the same as the forming of the second bubble 251 under the second bubble generating element 250. Accordingly, the chamber 210 is thereby isolated from the manifold 220 when the first bubble 141 and second bubble 251 simultaneously reach a predetermined size. At this time, the first bubble 241 serves as a virtual valve. The second bubble 251 is constrained by the wall 211 of the chamber 210 and pushes the ink in the chamber 210 with the first bubble 241. Then, the ink in the chamber 210 is ejected via the orifice 230 and in the form of an ink droplet 290 by the first bubble 241 and second bubble 251, as shown in FIG. 4C.

In this embodiment, since the dimensions of the first bubble generating element 240 and second bubble generating element 250 are the same, the formation speeds and sizes of the first bubble 241 and second bubble 251 are the same. The fluid ejection apparatus 200 can have a virtual valve to reduce the crosstalk in the chamber 210. Also, oblique and unstable ink ejection can be prevented.

Third Embodiment

Figure 5A:
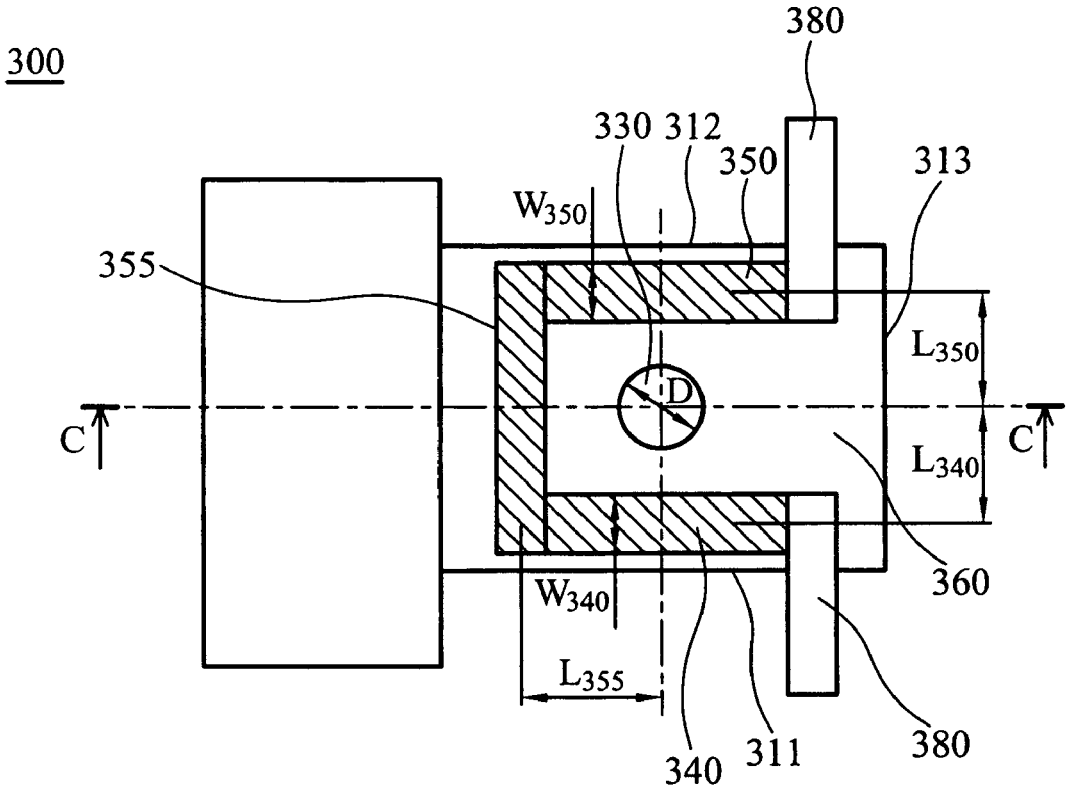
FIG. 5A is a schematic top view showing the fluid ejection apparatus of the third embodiment of the invention.
Figure 5B:
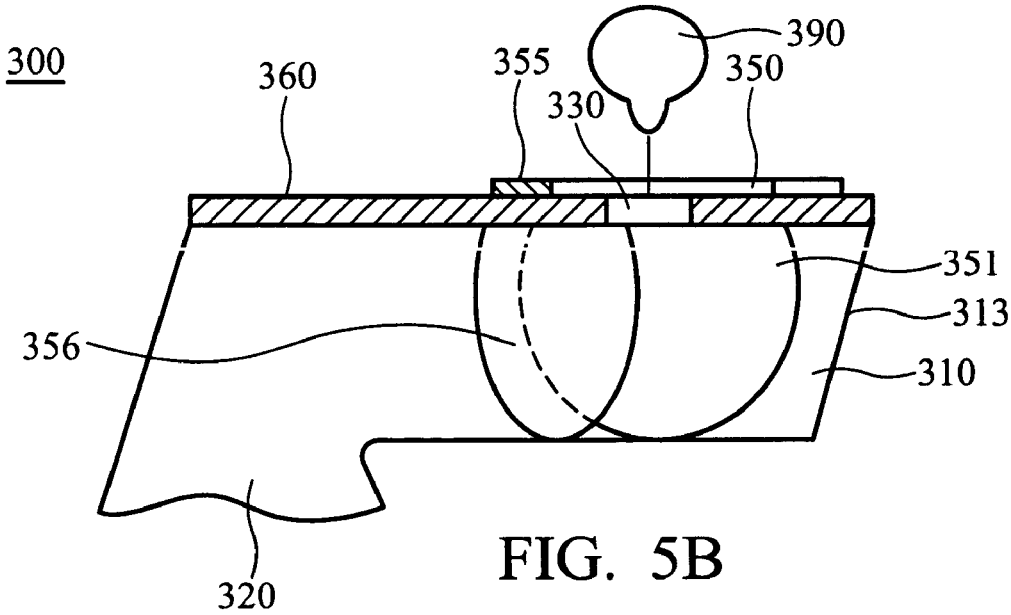
FIG. 5B is a schematic cross section taken along C-C of FIG. 5A.

Referring to FIG. 5A and FIG. 5B, the fluid ejection apparatus 300 of this embodiment includes a chamber 310, a manifold 320, an orifice 330, a first bubble generating element 340, a second bubble generating element 350, a third bubble generating element 355 and a substrate 360. The manifold 320 is connected to the chamber 310. Fluid, such as ink, flows into the chamber 310 through the manifold 320. The orifice 330 is formed on the substrate 360 and is connected to the chamber 310. The first bubble generating element 340, second bubble generating element 350 and third bubble generating element 355 are disposed above the chamber 310 and close to the orifice 330. Meanwhile, the third bubble generating element 355 is substantially disposed above the connection between the manifold 320 and the chamber 310. The first bubble generating element 340 and second bubble generating element 350 are substantially parallel to the direction in which the ink flows into the chamber 310 from the manifold 320. The first bubble generating element 340 and second bubble generating element 350 are connected and perpendicular to the third bubble generating element 355, as shown in FIG. 5A.

In this embodiment, the width $W_{340}$ of the first bubble generating element 340 is equal to the width $W_{350}$ of the second bubble generating element 350, and the length of the first bubble generating element 340 is equal to the length of the second bubble generating element 350. Meanwhile, the diameter of the orifice 330 is D. The distance $L_{340}$ between the center of the first bubble generating element 340 and the center of the orifice 330, distance $L_{350}$ between the center of the second bubble generating element 350 and the center of the orifice 330 and distance $L_{355}$ between the center of the third bubble generating element 355 and the center of the orifice 330 are the same. Additionally, the ratio of the distance $L_{340}$, $L_{350}$ or $L_{355}$ to the diameter D of the orifice 330 is between 0.8 and 1.2.

Specifically, the materials of the first, second and third bubble generating elements 340, 350, 355 are the same.

Accordingly, when the fluid ejection apparatus 300 is loaded with electric current via a wire 380, the electric current sequentially flows through the first bubble generating element 340, third bubble generating element 355 and second bubble generating element 350. The first, second and third bubble generating elements 340, 350, 355 are respectively heated because of their resistances.

When the temperatures of the first, second and third bubble generating elements 340, 350, 355 continue to rise, the ink thereunder is heated and vaporized to a first bubble (not shown), a second bubble 351 and a third bubble 356, respectively, as shown in FIG. 5B. Specifically, since the $W_{340}$ of the first bubble generating element 340 is equal to the width $W_{350}$ of the second bubble generating element 350, the volume of the first bubble generating element 340 is equal to the volume of the second bubble generating element 350. Namely, the resistance of the first bubble generating element 340 is equal to the resistance of the second bubble generating element 350. The heat generated by the first bubble generating element 340 is thereby equal to the heat generated by the second bubble generating element 350. The forming of the first bubble under the first bubble generating element 340 is the same as the forming of the second bubble 351 under the second bubble generating element 350. In another aspect, when the third bubble 356 generated by the third bubble generating element 355 reaches a predetermined size, the chamber 310 is isolated from the manifold 320 thereby. At this time, the third bubble 356 serves as a virtual valve. In addition, because of the constraint of the first wall 311, second wall 312 and third wall 313 of the chamber 310, the third bubble 356, first bubble and second bubble 351 simultaneously push the ink in the chamber 310. Then, the ink in the chamber 310 is ejected via the orifice 330 and in the form of an ink droplet 390 by the third bubble 356, first bubble and second bubble 351, as shown in FIG. 5B.

Fourth Embodiment

Figure 6A:
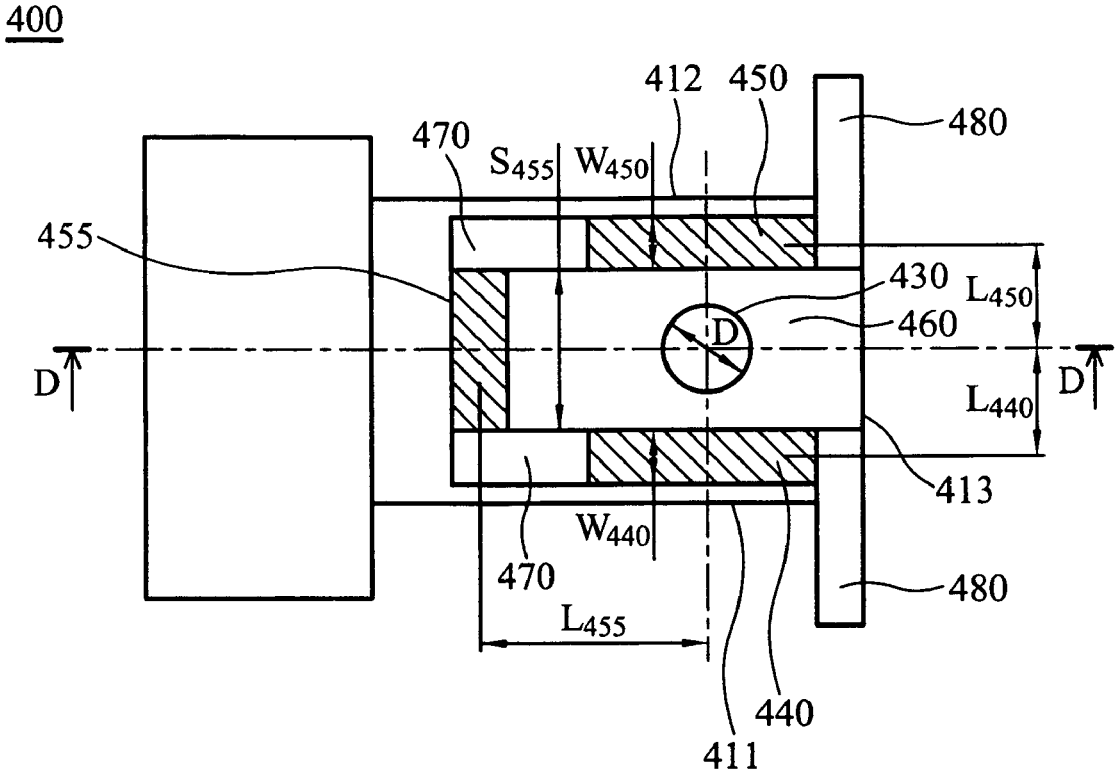
FIG. 6A is a schematic top view showing the fluid ejection apparatus of the fourth embodiment of the invention.
Figure 6B:
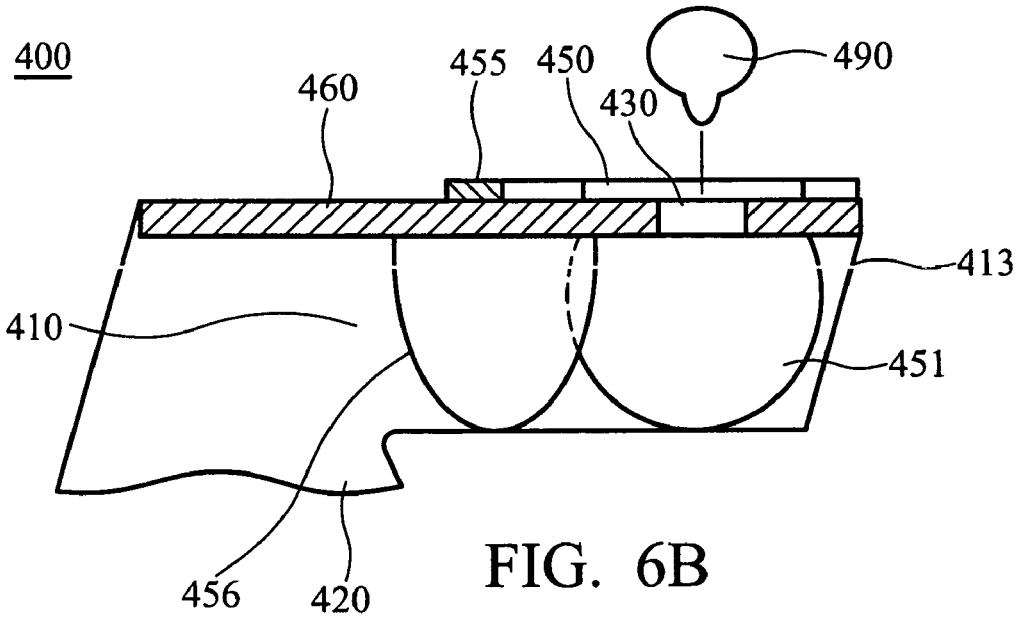
FIG. 6B is a schematic cross section taken along D-D of FIG. 6A.

Referring FIG. 6A and FIG. 6B, the fluid ejection apparatus 400 of this embodiment includes a chamber 410, a manifold 420, an orifice 430, a first bubble generating element 440, a second bubble generating element 450, a third bubble generating element 455 and a substrate 460. The manifold 420 is connected to the chamber 410. Fluid, such as ink, flows into the chamber 410 through the manifold 420. The orifice 430 is formed on the substrate 460 and is connected to the chamber 410. The first bubble generating element 440, second bubble generating element 450 and third bubble generating element 455 are disposed above the chamber 410 and close to the orifice 430. Meanwhile, the third bubble generating element 455 is substantially disposed above the connection between the manifold 420 and the chamber 410. The first bubble generating element 440 and second bubble generating element 450 are substantially parallel to the direction in which the ink flows into the chamber 410 from the manifold 420. The first bubble generating element 440 and second bubble generating element 450 are connected and perpendicular to the third bubble generating element 455, as shown in FIG. 6A. In addition, the fluid ejection apparatus 400 further includes a plurality of wires 470 connected between the first bubble generating element 440 and the third bubble generating element 455 and between the second bubble generating element 450 and the third bubble generating element 455.

In this embodiment, the width $W_{440}$ of the first bubble generating element 440 is equal to the width $W_{450}$ of the second bubble generating element 450, and the length of the first bubble generating element 440 is equal to the length of the second bubble generating element 450. Meanwhile, the diameter of the orifice 430 is D. The distance $L_{440}$ between the center of the first bubble generating element 440 and the center of the orifice 430 is equal to the distance $L_{450}$ between the center of the second bubble generating element 450 and the center of the orifice 430. The ratio of the distance $L_{440}$ or $L_{450}$ to the diameter D of the orifice 330 is between 0.8 and 1.2. Additionally, the ratio of the distance $L_{455}$ between the center of the third bubble generating element 455 and the center of the orifice 430 to the diameter D of the orifice 430 is between 0.5 and 5. The ratio of the length $S_{455}$ of the third bubble generating element 455 to the diameter D of the orifice 430 is between 0.5 and 2.

Specifically, the materials of the first, second and third bubble generating elements 440, 450, 455 are the same, and the material of the wires 470 has low resistance.

Accordingly, when the fluid ejection apparatus 400 is loaded with electric current via a wire 480, the electric current sequentially flows through the first bubble generating element 440, wire 470, third bubble generating element 455, wire 470 and second bubble generating element 350. The first, second and third bubble generating elements 440, 450, 455 are respectively heated because of their resistances. Meanwhile, since the material of the wires 470 has low resistance, heat generated thereby can be substantially eliminated.

When the temperatures of the first, second and third bubble generating elements 440, 450, 455 continue to rise, the ink thereunder is heated and vaporized to a first bubble (not shown), a second bubble 451 and a third bubble 456, respectively, as shown in FIG. 6B. Specifically, since the $W_{440}$ of the first bubble generating element 440 is equal to the width $W_{450}$ of the second bubble generating element 450, the volume of the first bubble generating element 440 is equal to the volume of the second bubble generating element 450. Namely, the resistance of the first bubble generating element 440 is equal to the resistance of the second bubble generating element 450. The heat generated by the first bubble generating element 440 is thereby equal to the heat generated by the second bubble generating element 450. The forming of the first bubble under the first bubble generating element 440 is the same as the forming of the second bubble 451 under the second bubble generating element 450. In another aspect, when the third bubble 456 generated by the third bubble generating element 455 reaches a predetermined size, the chamber 410 is thereby isolated from the manifold 420. At this time, the third bubble 456 serves as a virtual valve. In addition, because of the constraint of the first wall 411, second wall 412 and third wall 413 of the chamber 410, the third bubble 456, first bubble and second bubble 451 simultaneously push the ink in the chamber 410. Then, the ink in the chamber 410 is ejected via the orifice 430 and in the form of an ink droplet 490 by the third bubble 456, first bubble and second bubble 451, as shown in FIG. 6B.

In conclusion, the fluid ejection apparatuses of the invention obtain different virtual valves by means of adjusting or changing the geometric shapes and sizes of the bubble generating elements, thereby reducing the crosstalk in the chamber thereof. Furthermore, the sizes of the bubble generating elements are accurately designed and controlled to match the geometric shape of the chamber, such that oblique and unstable ink ejection can be prevented.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fluid ejection apparatus, comprising:

a chamber containing fluid;

a manifold connected to the chamber, wherein the fluid flows into the chamber therethrough in a first direction;

an orifice connected to the chamber;

a first bubble generating element disposed above the chamber and close to the orifice to generate a first bubble, the first bubble generating element having a width defined in a direction parallel to the first direction; and a second bubble generating element disposed above the chamber and close to the orifice to generate a second bubble, the second bubble generating element having a width defined in a direction parallel to the first direction, wherein the first bubble generating element is closer to the manifold than the second bubble generating element, the fluid in the chamber is ejected via the orifice by the first and second bubbles, the ratio of the distance between the center of the first bubble generating element and the center of the orifice to the diameter of the orifice is between 0.7 and 1.3, the ratio of the distance between the center of the second bubble generating element and the center of the orifice to the diameter of the orifice is between 0.7 and 1.3, and the ratio of the width of the first bubble generating element to the width of the second bubble generating element is between 1.0 and 1.2.

2. The fluid ejection apparatus as claimed in claim 1, wherein the distance between the center of the first bubble generating element and the center of the orifice is equal to the distance between the center of the second bubble generating element and the center of the orifice.

3. The fluid ejection apparatus as claimed in claim 1, wherein the first bubble serves as a virtual valve.

4. The fluid ejection apparatus as claimed in claim 1, wherein the first bubble generating element and the second bubble generating element each have a length defined in a second direction perpendicular to the first direction, and the lengths of the first and second bubble generating elements are greater than the widths of the first and second bubble generating elements, respectively.

5. The fluid ejection apparatus as claimed in claim 4, wherein orifice is interposed between the first bubble generating element and the second bubble generating element.

* * * * *